US005193773A

United States Patent [19]

Middleton

[11] Patent Number: 5,193,773

[45] Date of Patent: Mar. 16, 1993

[54] ROOF BUCKET HOLDER APPARATUS

[76] Inventor: Larry C. Middleton, 57 Puma Dr., Hendersonville, N.C. 28739

[21] Appl. No.: 826,421

[22] Filed: Jan. 27, 1992

[51] Int. Cl.[5] ..... A47G 23/02

[52] U.S. Cl. ..... 248/148

[58] Field of Search ..... 248/148, 129, 136, 237, 248/447, 462

[56] References Cited

U.S. PATENT DOCUMENTS

| | | | |
|---|---|---|---|
| 548,284 | 10/1895 | Atkinson et al. | 248/136 |
| 677,645 | 7/1901 | Elkins | 182/45 X |
| 1,188,610 | 6/1916 | Berger | 248/136 |
| 4,450,935 | 5/1984 | Gustavus | 248/237 X |
| 4,962,906 | 10/1990 | Fatool et al. | 248/148 |
| 5,002,293 | 3/1991 | Gottselig | 248/129 X |

*Primary Examiner*—Ramon O. Ramirez
*Attorney, Agent, or Firm*—Leon Gilden

[57] ABSTRACT

An articulated framework is arranged for mounting to a top portion of a peaked roof, with a pivoted tray structure to secure a bucket thereon for use in roof repair and construction. A modification of the invention includes the articulated framework arranged to mount a vehicular cart for reciprocation relative to the articulated framework.

5 Claims, 4 Drawing Sheets

ROOF BUCKET HOLDER APPARATUS

BACKGROUND OF THE INVENTION

1. Field of the Invention

The field of invention relates to roof construction apparatus, and more particularly pertains to a new and improved roof bucket holder apparatus wherein the same is arranged to secure a bucket and other building materials relative to roof construction and repair.

2. Description of the Prior Art

In roof repair and construction, various roof sealers, paints, building materials, and the like are required for use and particularly with peaked roofs, the support and securement of such building components are of awkward and cumbersome consideration. The instant invention attempts to overcome deficiencies of the prior art by providing an organization arranged to adjustably accommodate various building materials thereon. The prior art bucket holder is illustrated in U.S. Pat. No. 4,452,415 to Arnold setting forth a bracket structure to merely support a bail of an associated bucket thereon.

U.S. Pat. No. 4,776,550 to Storey sets forth a paint bucket holder for mounting to a ladder structure.

U.S. Pat. No. 4,519,565 to Whitmore sets forth a paint bucket holder for positioning relative to a roof member, wherein the apparatus includes magnetic base portions for securement to a ferrous metallic roof.

As such, it may be appreciated that there continues to be a need for a new and improved roof bucket holder apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bucket holder apparatus now present in the prior art, the present invention provides a roof bucket holder apparatus wherein the same utilizes articulated framework mounting an adjustable frame plate for supporting a bucket or other building materials thereon. As such, the general purpose of the present invention, which will be described subsequently in greater detail, is to provide a new and improved roof bucket holder apparatus which has all the advantages of the prior art bucket holder apparatus and none of the disadvantages.

To attain this, the present invention provides an articulated framework arranged for mounting to a top portion of a peaked roof, with a pivoted tray structure to secure a bucket thereon for use in roof repair and construction. A modification of the invention includes the articulated framework arranged to mount a vehicular cart for reciprocation relative to the articulated framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roof bucket holder apparatus which has all the advantages of the prior art bucket holder apparatus and none of the disadvantages.

It is another object of the present invention to provide a new and improved roof bucket holder apparatus which may be easily and efficiently manufactured and marketed.

It is a further object of the present invention to provide a new and improved roof bucket holder apparatus which is of a durable and reliable construction.

An even further object of the present invention is to provide a new and improved roof bucket holder apparatus which is susceptible of a low cost of manufacture with regard to both materials and labor, and which accordingly is then susceptible of low prices of sale to the consuming public, thereby making such roof bucket holder apparatus economically available to the buying public.

Still yet another object of the present invention is to provide a new and improved roof bucket holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
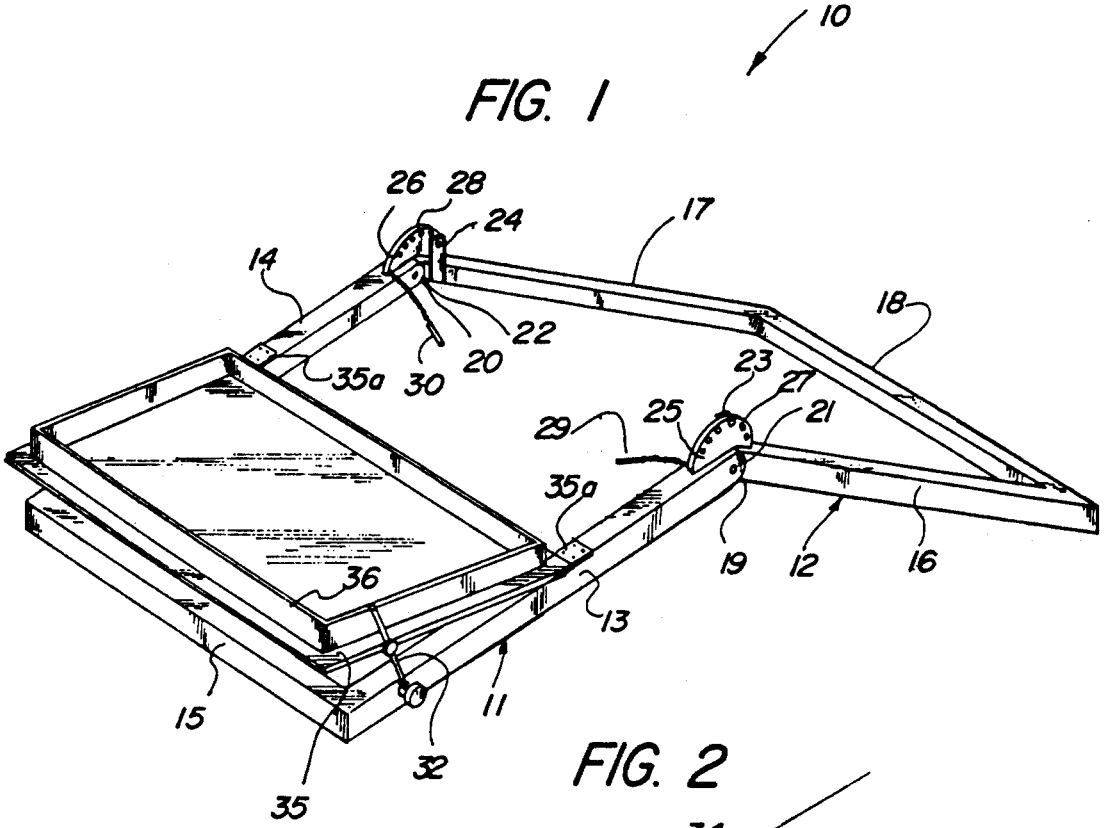
FIG. 1 is an isometric illustration of the instant invention.
Figure 2:
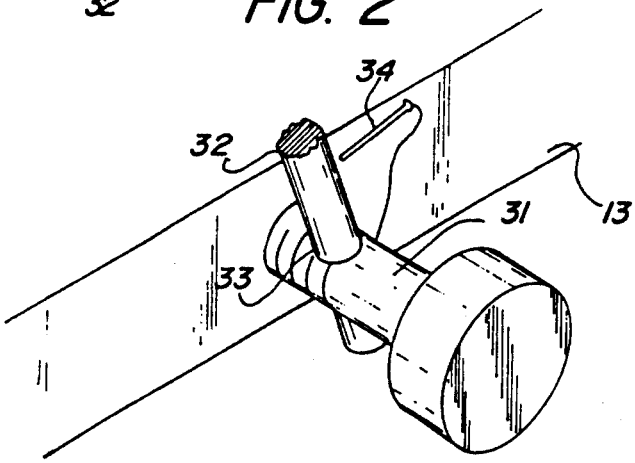
FIG. 2 is an isometric illustration of the slip rod member of FIG. 1.

With reference now to the drawings, and in particular to FIGS. 1 to 7 thereof, a new and improved roof bucket holder apparatus embodying the principles and concepts of the present invention and generally designated by the reference numerals 10 and 10*a* will be described.

More specifically, the roof bucket holder apparatus 10 of the instant invention essentially comprises a first U-shaped frame 11 pivotally mounted to a second U-shaped frame 12. The first U-shaped frame 11 includes a frame first leg 13 spaced from and parallel a first frame second leg 14, with a first frame connecting web 15 orthogonally directed between the first frame first leg and the first frame second leg to define the first U-shaped frame 11. The second U-shaped frame 12 includes a second frame first leg 16 spaced from and parallel a second frame second leg 17, with a second frame connecting web 18 orthogonally directed between the first leg and second leg. The first frame first leg 13 and the second frame first leg 16 are pivotally mounted at a first junction about a first axle 21. The first frame second leg 14 and the second frame second leg 17 are pivotally mounted about a second junction 20 and more specifically about a second axle 22. A first bracket 23 fixedly mounted to the second frame first leg 16 extending orthogonally upwardly thereof in a parallel relationship relative to a second bracket 24 fixedly and orthogonally mounted to the second frame second leg 16. A first arcuate bracket 25 fixedly mounted to the first frame first leg 13 is arranged for rotation relative to the first bracket 23, with the first arcuate bracket 25 including a semi-circular array of first apertures 27. A second arcuate bracket 26 fixedly mounted to the first frame second leg 14 is arranged for rotation past the second bracket 24. A first lock pin 29 is arranged for projection through one of said first apertures 27 and through a first bracket aperture, with a second lock pin 30 directed through one of said second apertures 28 and through a second bracket aperture 26 in the second bracket. Accordingly, the first bracket aperture is radially spaced relative to the first axle 21 an equal spacing relative to the first apertures 27. The second bracket aperture of the second bracket 26 is radially spaced from the second axle 22 an equal spacing relative to the spacing of the second apertures 28 relative to the second axle 22.

Alignment axle 31 slidably receives a slip rod 32 therethrough, with the slip rod 32 pivotally mounted to a side edge of the tray plate 35 positioned above the first U-shaped frame 11 and pivotally mounted about tray plate hinges 35*a*. The slip rod 32 includes a series of slip rod apertures 33 directed through the slip rod, with a third lock pin 34 arranged for reception through one of said slip rod apertures 33 above the alignment axle 31 to position the tray plate 35 at adjustable angular relationship relative to the first U-shaped frame 11. The tray plate 35 includes a continuous perimeter frame 36 fixedly and orthogonally mounted to a top surface of the tray plate 35 for containing a bucket or other building materials therewithin.

Figure 3:
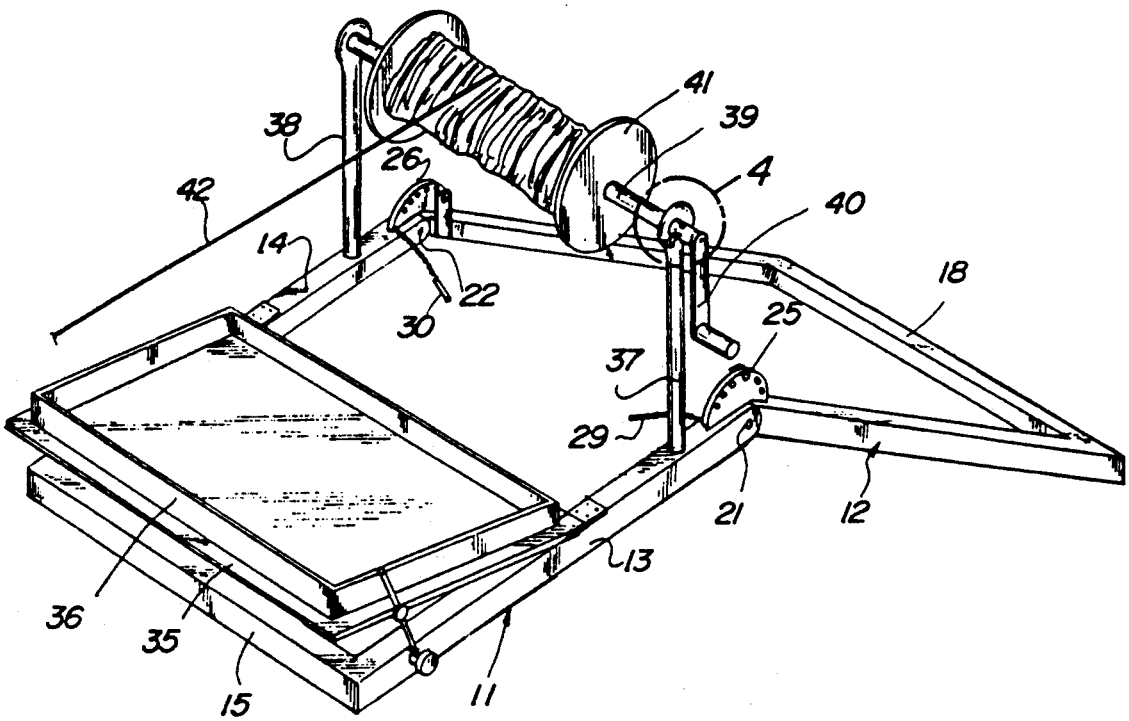
FIG. 3 is an isometric illustration of a modified articulated framework structure utilized by the invention in association with a vehicular cart.
Figure 4:
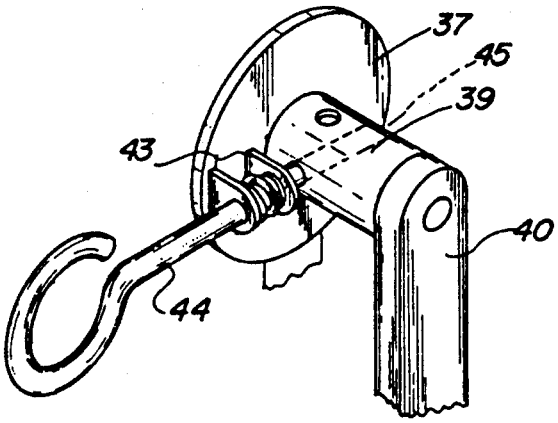
FIG. 4 is an enlarged isometric illustration of section 4 set forth in FIG. 3.
Figure 5:
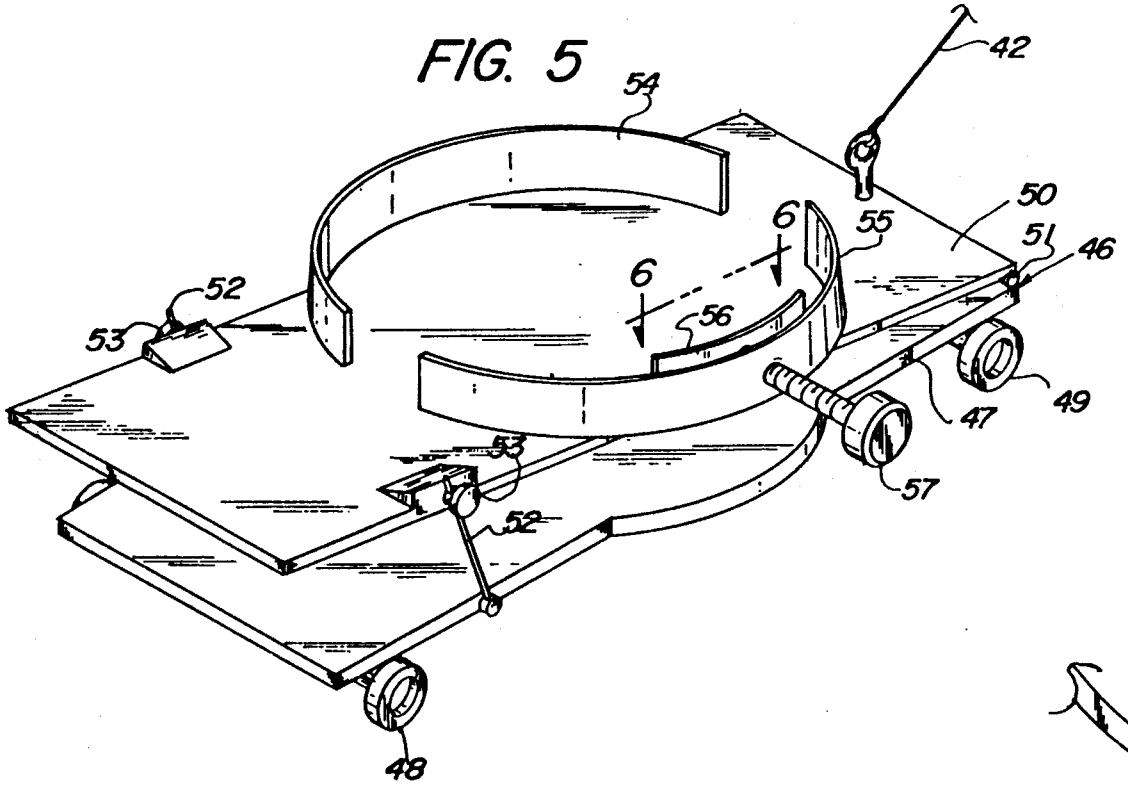
FIG. 5 is an isometric illustration of the vehicular cart utilized by the invention.
Figure 6:
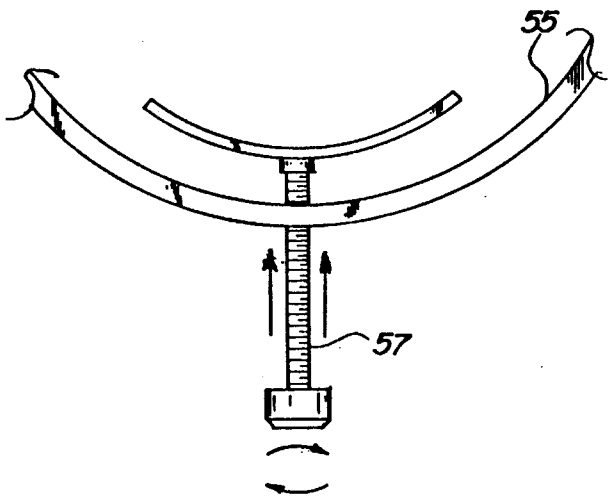
FIG. 6 is an orthographic view, taken along the lines 6—6 of FIG. 5 in the direction indicated by the arrows.
Figure 7:
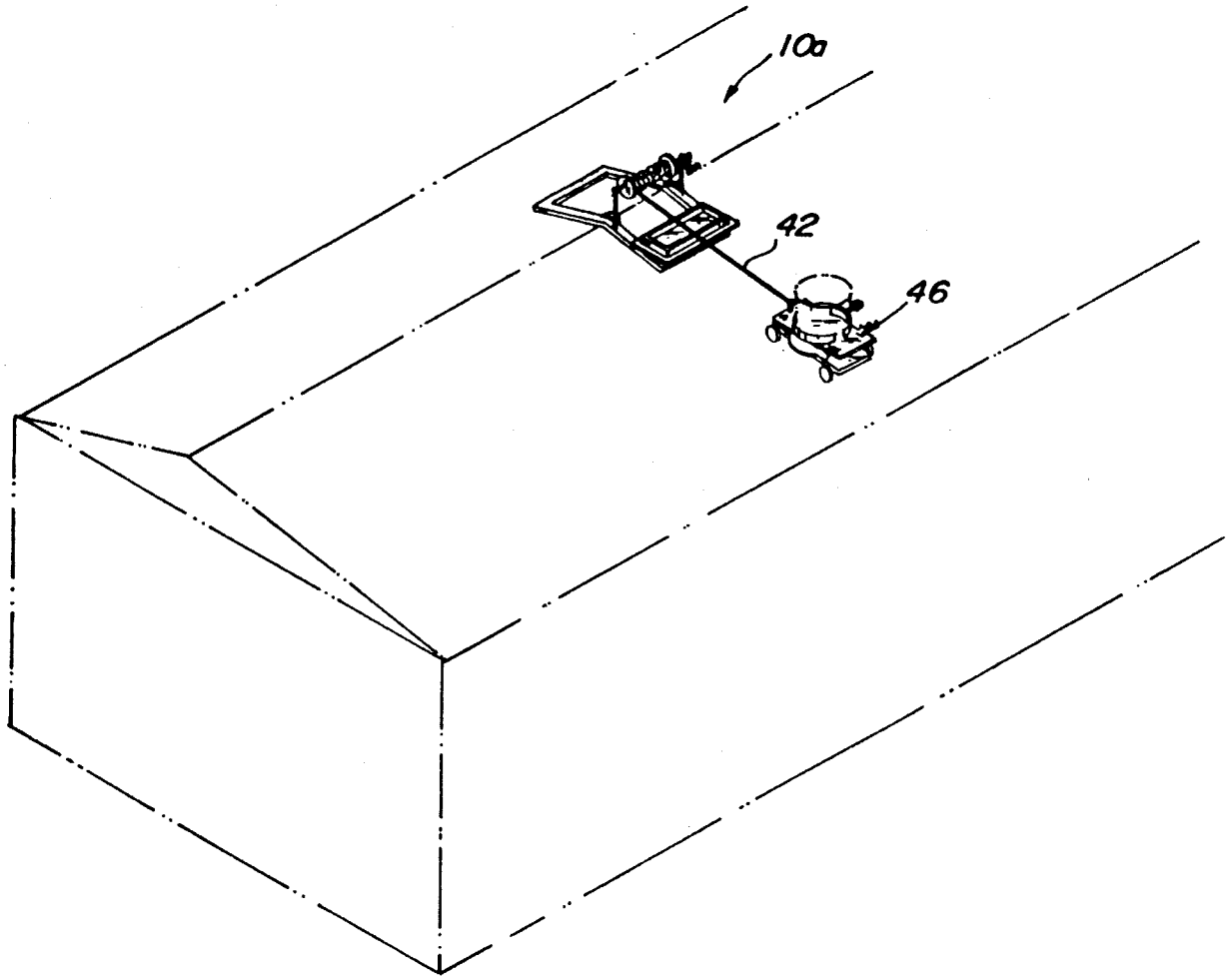
FIG. 7 is an isometric illustration of the modified invention in an assembled configuration.

The modified framework, as illustrated in FIG. 3, and in the organization 10*a* as set forth in FIG. 7, includes a first support rod 37 parallel to a second support rod 38, wherein the first and second support rods 37 and 38 are coextensive and fixedly mounted to the respective first frame first leg 13 and the first frame second leg 14 respectively. A windlass axle 39 is rotatably directed through upper distal ends of the first and second support rods 37 and 38 that are arranged in an orthogonal relationship relative to the first and second support rods 37 and 38, with a windlass axle handle 40 orthogonally mounted to a first end of the windlass axle 39 positioned exteriorly of the first support rod 37. A windlass drum 41 is fixedly mounted to the windlass axle 39, as illustrated, with a cable 42 wound about the windlass drum 41, with a free distal end of the windlass cable 42 mounted to a vehicular cart 46, as illustrated in the FIGS. 5 and 7. A plurality of first support pin plates 43 are fixedly mounted to the first support rod 37 adjacent the windlass axle 39 for alignment with a windlass axle bore 45 that receives a fourth lock pin 44 through the support plates 43 and the windlass axle bore 45 to effect locking of the windlass drum 41 relative to the support rods 37 and 38 to effect positioning of the vehicular cart 46 as required.

The vehicular cart 46 includes a vehicular cart base plate 47 mounting a pair of forward wheels 48 spaced from a pair of rear wheels 49 permitting rolling of the vehicular cart 46 about a roof surface. A vehicular cart pivot plate 50 is hingedly mounted to the vehicular cart base plate 47 about a pivot plate hinge 51. A plurality of pivot plate slip rods 52 each pivotally mounted at their lower ends to the vehicular cart base plate 47 are slidably received through pivot plate lock members 53 to permit angular adjustment of the pivot plate 50 relative to the base plate 47.

A respective first and second semi-circular rim 54 and 55 are arranged in concentric relationship relative to one another diametrically opposed to one another fixedly mounted to the top surface of the pivot plate 50. A semi-cylindrical clamp ring 56 is positioned within semi-cylindrical second rim 55 mounted to a forward distal end of an externally threaded adjuster rod 57 diametrically directed through the second rim 55 to permit radial adjustment of the semi-cylindrical clamp ring 56 to effect clamping of a bucket member and the like between the clamp ring 56 and the first rim 54.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof bucket holder apparatus, comprising, a first U-shaped frame pivotally mounted to a second U-shaped frame, wherein the first U-shaped frame includes a first frame first leg spaced from and parallel a first frame second leg, and the second frame including a second frame first leg spaced from and parallel a second frame second leg, the first frame first leg hingedly mounted to the second frame second leg about a first axle and the first frame second leg hinged mounted to the second frame first leg about a second axle, and the second frame first leg includes a first bracket, including a first bracket bore fixedly mounted to the second frame first leg adjacent the first axle, and a second bracket including a second bracket bore fixedly mounted to the second frame second leg adjacent the second axle, and a first arcuate bracket positioned for sliding contiguously relative to the first bracket arranged fixedly to the first frame first leg, with the first arcuate bracket including a semi-circular array of first apertures, wherein one of said first apertures is arranged for alignment with said first bracket bore, and a second arcuate bracket fixedly mounted to the first frame second leg and includes a semi-circular array of second apertures, wherein one of said second apertures is arranged for alignment with said second bracket bore, and a first lock pin is arranged for projection through the first arcuate bracket and the first bracket and a second lock pin is arranged for projection through the second arcuate bracket and the second bracket.

2. An apparatus as set forth in claim 1 wherein an alignment axle is fixedly mounted to the first frame first leg spaced from the first axle, and a tray plate is hingedly mounted and extends orthogonally between the first frame first leg and the first frame second leg, the tray plate including at least one tray plate hinge to hingedly mount the tray plate to the first frame first leg and the first frame second leg, the tray plate including a slip rod pivotally mounted to a side edge of the tray plate, wherein the slip rod is slidably received through the alignment axle, and a fastener member is arranged for projection through the slip rod to effect angular orientation of the tray plate relative to the first U-shaped frame, and a continuous perimeter frame is fixedly and orthogonally mounted to a top surface of the tray plate to contain a work component positioned therewithin.

3. An apparatus as set forth in claim 2 including a first support rod fixedly mounted to the first frame first leg adjacent the first axle, and a second support rod parallel to and coextensive with the first support rod is fixedly mounted to the first frame second leg adjacent the second axle, and the first support rod and the second support rod orthogonally receive a windlass axle rotatably directed therethrough, wherein the windlass axle includes a windlass axle handle fixedly mounted to a first end of the windlass axle exteriorly of the first support rod, and a windlass drum fixedly mounted to the windlass axle between the first support rod and the second support rod, and a cable wound about the windlass axle, and a free distal end of the cable spaced from the windlass drum is secured to a vehicular cart.

4. An apparatus as set forth in claim 3 wherein the first support rod includes a plurality of support pin plates fixedly mounted to the first support rod adjacent the windlass axle, and the windlass axle includes a windlass axle bore, and a windlass axle lock pin is arranged for projection through the support pin plates and the windlass axle bore for fixedly securing the windlass axle and the windlass drum relative to the first support rod and the second support rod.

5. An apparatus as set forth in claim 4 wherein the vehicular cart includes a base plate, the base plate includes a plurality of forward wheels and a plurality of rear wheels rotatably mounted to a bottom surface of the vehicular cart base plate, and a pivot plate hingedly mounted to the base plate about a pivot plate hinge, and at least one pivot plate slip rod pivotally mounted to the base plate, with the pivot plate slip rod received through a pivot plate fastener to effect angular adjustment of the pivot plate relative to the base plate, and the pivot plate including a first semi-cylindrical rim fixedly mounted to a top surface of the pivot plate, and a second semi-cylindrical rim fixedly mounted to the top surface of the pivot plate, wherein the first semi-cylindrical rim and the second semi-cylindrical rim are fixedly mounted at diametrically opposed relationships concentrically oriented relative to one another, with the second semi-cylindrical rim including a semi-cylindrical clamp ring positioned between the first semi-cylindrical rim and the second semi-cylindrical rim, wherein the semi-cylindrical clamp plate includes an externally threaded rod diametrically directed through the semi-cylindrical rim and threadedly received through the second semi-cylindrical rim to effect adjustment of the semi-cylindrical clamp ring relative to the first semi-cylindrical rim for clamping a workpiece therebetween.

* * * * *